US005427553A

United States Patent [19]

Tsuji

[11] Patent Number: 5,427,553

[45] Date of Patent: Jun. 27, 1995

[54] FEMALE TYPE METAL CONNECTION TERMINAL

[75] Inventor: Masanori Tsuji, Shizuoka, Japan

[73] Assignee: Yazaki Corporation, Japan

[21] Appl. No.: 86,829

[22] Filed: Jul. 7, 1993

[30] Foreign Application Priority Data

Jul. 8, 1992 [JP] Japan ..... 4-047723 U

[51] Int. Cl.[6] ..... H01R 11/22

[52] U.S. Cl. ..... 439/851; 439/842

[58] Field of Search ..... 439/842–847, 439/851–856, 861, 839, 833

[56] References Cited

U.S. PATENT DOCUMENTS

| | | | |
|---|---|---|---|
| 4,342,498 | 8/1982 | Patton et al. | 439/839 |
| 4,690,478 | 9/1987 | Rahrig et al. | 439/851 |
| 5,147,230 | 9/1992 | Plyler et al. | 439/843 |
| 5,186,664 | 2/1993 | Abe | 439/893 |

FOREIGN PATENT DOCUMENTS

| | | |
|---|---|---|
| 50-5894 | 1/1975 | Japan . |
| 54-12085 | 1/1979 | Japan . |
| 54-41591 | 3/1979 | Japan . |
| 55-36528 | 3/1980 | Japan . |
| 56-35775 | 4/1981 | Japan . |
| 59-20976 | 2/1984 | Japan . |
| 59-59480 | 4/1984 | Japan . |
| 60-78587 | 5/1985 | Japan . |
| 60-99783 | 7/1985 | Japan . |
| 60-109274 | 7/1985 | Japan . |
| 61-14472 | 1/1986 | Japan . |
| 1-10589 | 1/1989 | Japan . |
| 1-95077 | 6/1989 | Japan . |
| 1-112574 | 7/1989 | Japan . |

*Primary Examiner*—David L. Pirlot
*Attorney, Agent, or Firm*—Wigman, Cohen, Leitner & Myers

[57] ABSTRACT

A female type metal connection terminal comprising a base plate, a contact portion opposing the base plate, and an elastic contact piece provided for the base plate and including a sliding portion for sliding on the base plate, the sliding portion is provided with projecting portions projecting from the sliding portion towards the base plate, thereby facilitating the insertion of the mating connection terminal.

20 Claims, 5 Drawing Sheets

FEMALE TYPE METAL CONNECTION TERMINAL

BACKGROUND OF THE INVENTION

1. Technical Field

The present invention relates to a female type metal connection terminal In which a mating or male terminal is inserted and held in an electric connection portion having an elastic contact pieces.

2. Background Art

As the female type metal connection terminals mentioned above, female type metal connection terminals as disclosed in Japanese Utility Model Application for Disclosure Nos.(HEI)1-95077 and (HEI)1-112574 are known. Generally, the female metal connection terminal of this type has a base and a top plates between which a bent elastic contact piece is disposed. The space defined by the base and the elastic contact piece receives a male type connection terminal and the base plate and elastic contact piece holds the male terminal by grasping it between them.

As another known background art, there can be mentioned the female type metal connection terminal disclosed in Japanese Patent Application for Disclosure No.(SHO)64-10589. Like the female terminals described above, the female metal terminal of this type has a base and a top plates, and an elastic contact piece which is bent in the shape of arc is inserted between these plates. Moreover, the mating terminal is inserted and grasped between the base plate and the elastic contact piece of the female terminal.

However, in case of the female type metal connection terminals disclosed in these official gazettes, the elastic contact piece is also pressed against the base plate by force caused by grasping the mating terminal through the elastic contact piece. Therefore, the frictional resistance becomes great in the slide movement of the mating terminal between the elastic contact piece and the base plate, so that the mating terminal must be pressed therein with relatively great force.

SUMMARY OF THE INVENTION

It is therefore an object of the present invention to provide a female type metal connection terminal which can reduce the force required for inserting the mating terminal therein.

To achieve the object, the present invention provides a female type metal connection terminal comprising: a base plate, a contact portion opposing the base plate, and an elastic contact piece provided for said base plate and including a sliding portion for sliding on said base plate, said sliding portion is provided with projecting portions projecting from said sliding portion towards said base plate.

Namely, the female type metal connection terminal of the present invention has an elastic contact portion including portions projecting onto the base plate at its sliding portion. Thus, even in the event that the mating terminal is inserted and the elastic contact piece is pressed powerfully against the base plate, the contact piece can slide on the base plate in a point-contact state. Therefore, the force required for inserting the mating terminal can be reduced.

These and other objects, features and advantages of the present invention will be more apparent from the following description of a preferred embodiment, taken in conjunction with the accompanying drawings.

BRIEF DESCRIPTION OF THE DRAWINGS

FIG. 3A is a cross section showing a state in which the distal end of the mating terminal is inserted between the elastic contact piece and the base, while FIG. 3B is a cross section showing a state where the mating terminal is completely inserted therebetween.

FIG. 8A is a cross section showing a state in which the distal end of the mating terminal is inserted between the elastic contact piece and the base while FIG. 8B is a cross section showing a state where the mating terminal is completely inserted therebetween.

DESCRIPTION OF THE PREFERRED EMBODIMENT

First Embodiment

Now described here is the first embodiment of the female type metal connection terminal according to the present invention.

Figure 1:
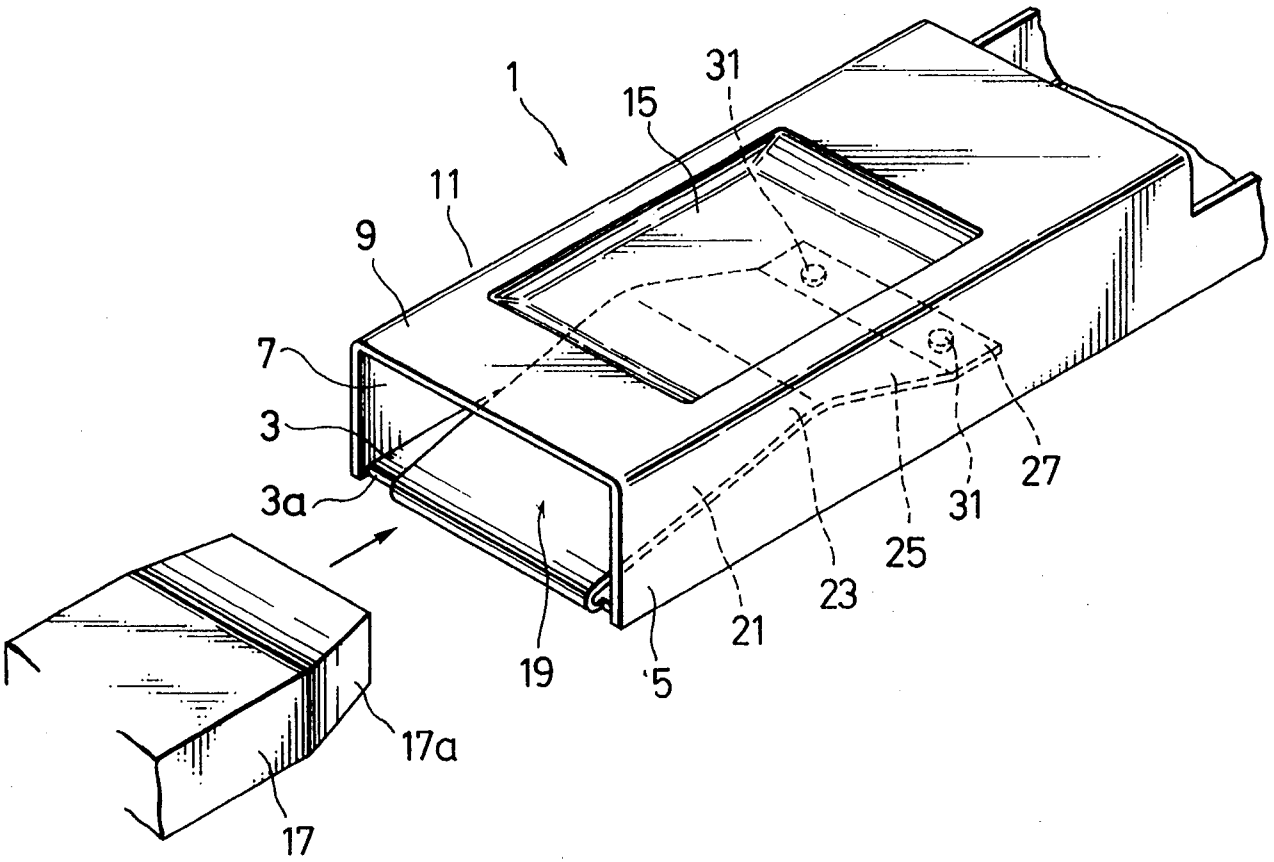
FIG.1 is a perspective view of the first embodiment of the female type metal connection terminal according to the present invention.
Figure 2:
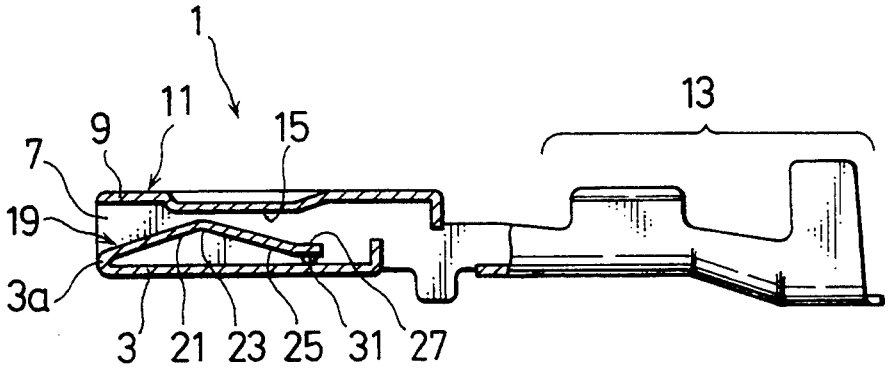
FIG.2 is a cross section for showing the interior of an electric contact portion of the female type metal connection terminal corresponding to the first embodiment.

FIGS. 1 and 2 show a female type metal connection terminal 1 corresponding to the first embodiment, respectively. As shown in the same drawings, the female type metal connection terminal 1 comprises a box type electric contact portion 11 constructed with a base plate 3, side walls 5, 7 respectively extending upward from the base plate 3 and a top plate 9 opposed to the base plate; and a wire gripping portion 13 integrally formed with the electric contact portion 11 for gripping and connecting a distal end of wire to the electric contact portion.

In the top plate 9 of electric contact portion 11 is formed a contact portion 15 which is bent or projecting in a rectangular form toward the base plate 3 so that the inner wall of contact portion 15 can be in contact with the distal end surface of a mating terminal 17 when it is inserted in the electric contact portion 11. Facing the contact portion 15, an elastic contact piece 19 is formed over the base plate 3 by bending the base plate 3 at its distal end 3*a* as shown in FIGS. 1 and 2. In more detail, the elastic contact piece 19 comprises a rising shoulder portion 21, a central portion 23 projecting toward the top plate 9, and a falling shoulder portion 25 defining a predetermined angle together with the rising shoulder portion 21 and extending from the central portion 23 toward the base plate 3, thereby presenting a virtually triangular shape. In addition, the distal end of falling shoulder portion 25 is bent along the base plate 3 to form a sliding portion 27 for slidably contacting with the base plate 3. Namely, a pair of convex portions 31, 31 are press-formed at the surface of sliding portion 27 facing the base plate 3 so as to slidably contact with the same plate 3. Each of the convex portions 31, 31 is sharpened and has a spherical distal end to slide on the base plate 3 in the point-contact mode.

With respect to the shape of convex portion 31, various shapes can be adopted as far as they satisfy the gist of the present invention. For example, semispherical or conical shapes can be used as the shape of member 31.

Figure 3A:
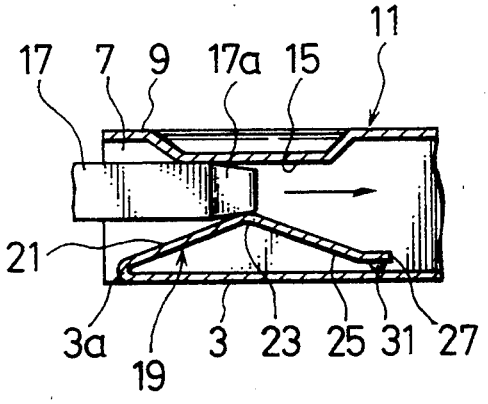
FIGS. 3A and 3B are given for showing insertion of the mating terminal into the electric contact portion of the female type metal connection terminal corresponding to the first embodiment. Namely.
Figure 3B:
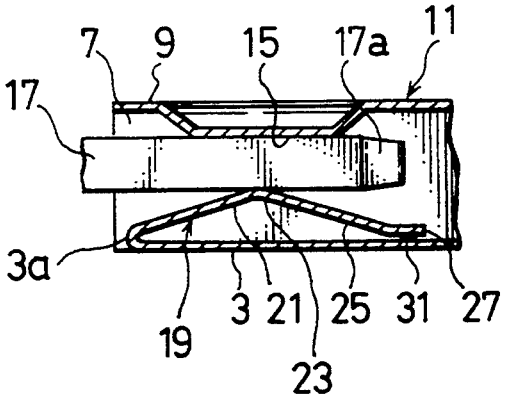

When the distal end 17*a* of mating terminal 17 is inserted, as shown in FIG. 3A, between the contact portion 15 and elastic contact piece 19 of the female type metal connection terminal 1, the rising shoulder portion 21 and falling shoulder portion 25 are slightly bent, and both of the convex portion 31, 31 of sliding portion are pressed onto the base plate 3. The more the mating terminal 17 is inserted between the contact portion 15 and elastic contact piece 19, the deeper the rising shoulder portion 21 and falling shoulder portion 25 are pressed as shown in FIG. 3B, so that the convex portions 31, 31 in the sliding portion 27 slide respectively on the base plate 3 In the point-contact manner. In this case, since both the convex portions 31, 31 slide on the base plate 3 in the point-contact manner, the frictional force can be reduced as compared with the background art as mentioned above, thereby reducing the insertion force of the mating terminal into the space between contact portion 15 and elastic contact piece 19.

Additionally, since the pair of convex portions 31, 31 are provided in the sliding portion 27 crossing the insertion direction of mating terminal 17, the stability of elastic contact piece 19 to the base plate 3 is highly enhanced.

Second Embodiment

Next, the second embodiment according to the present invention is described.

Figure 4:
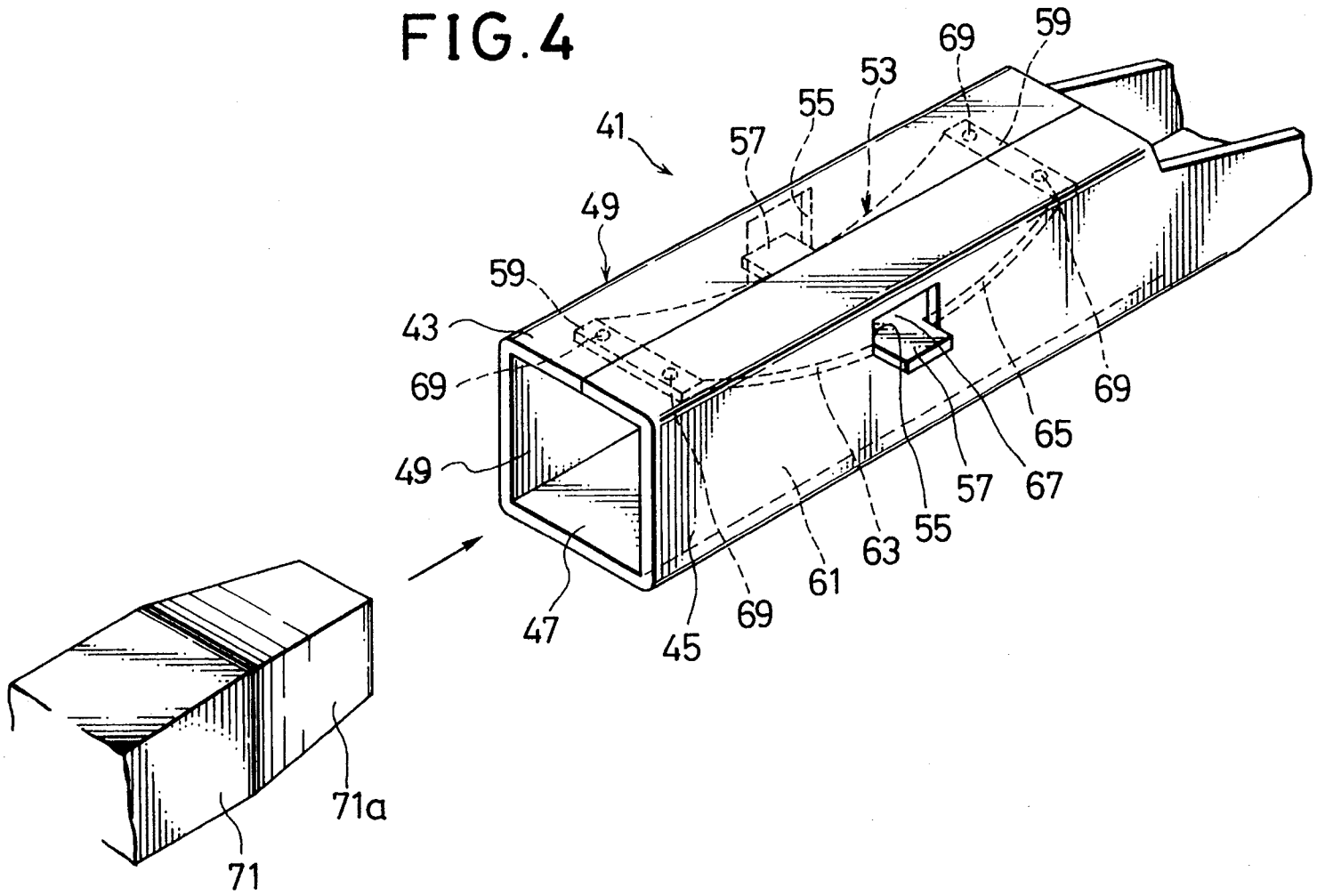
FIG.4 is a perspective view of the second embodiment of the female type metal connection terminal according to the present invention.
Figure 5:
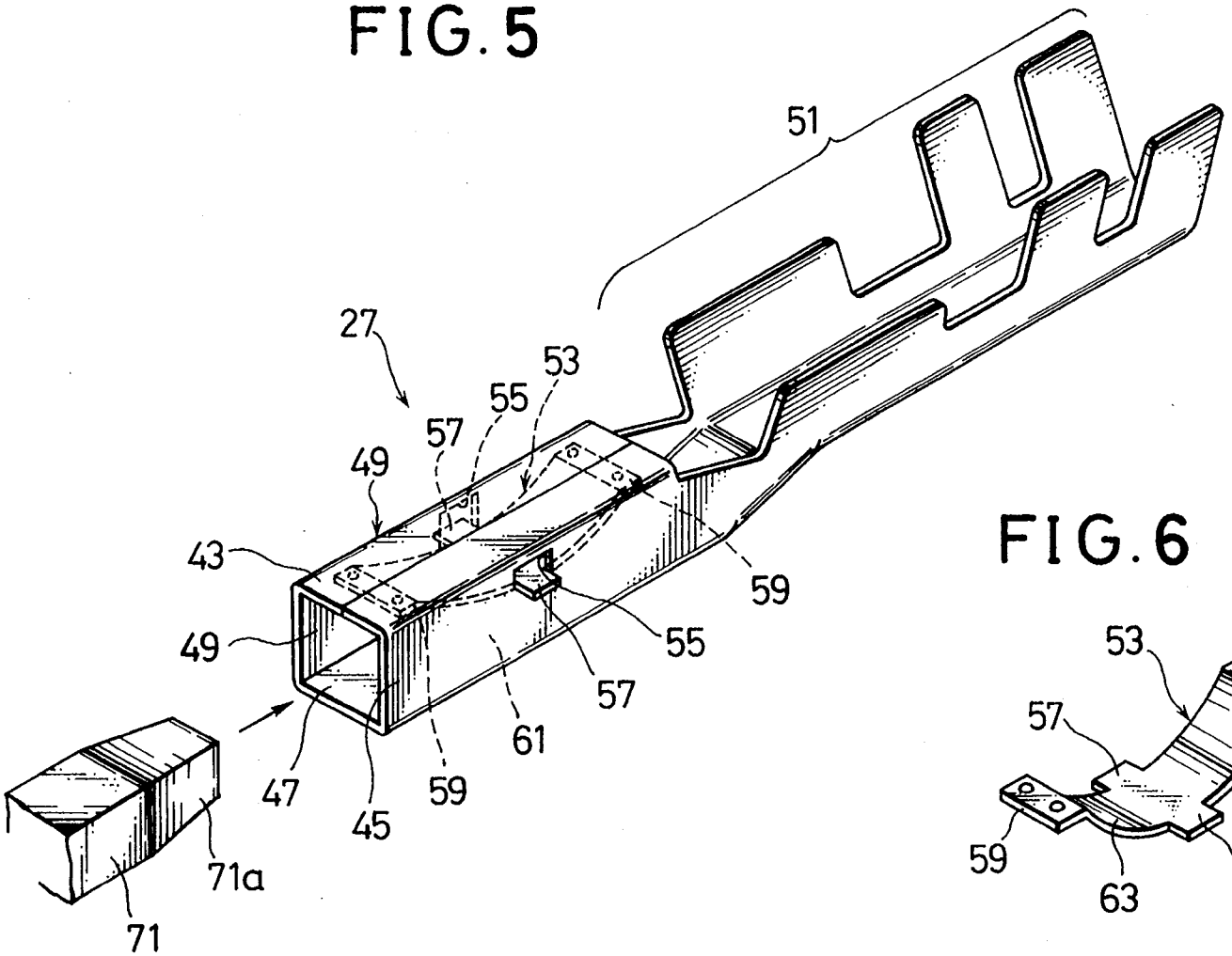
FIG.5 is a perspective view for showing the whole body of the female type metal connection terminal of the second embodiment.
Figure 6:
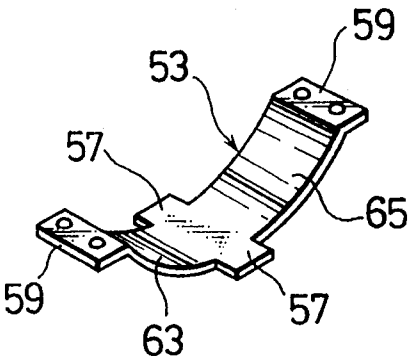
FIG.6 is a perspective view for showing the elastic contact piece of the second embodiment.
Figure 7:
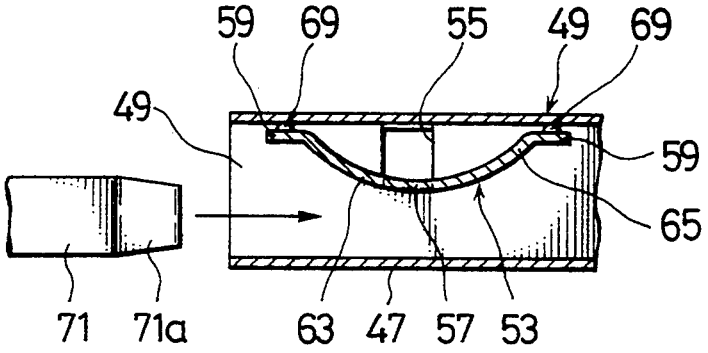
FIG.7 is a cross section showing the interior of an electric contact portion of the female type metal connection terminal corresponding to the second embodiment.
Figure 8A:
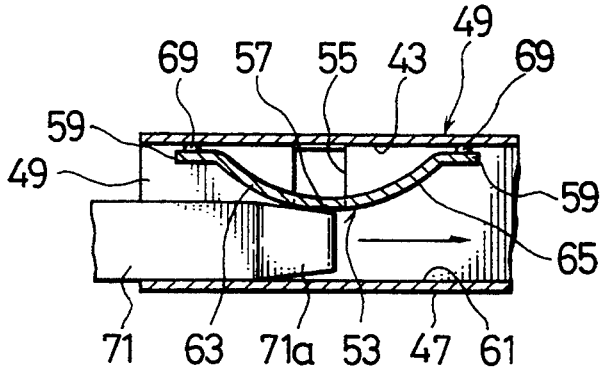
FIGS. 8A and 8B are provided for showing insertion of the mating terminal into the electric contact portion of the female type metal connection terminal corresponding to the second embodiment. Namely.
Figure 8B:
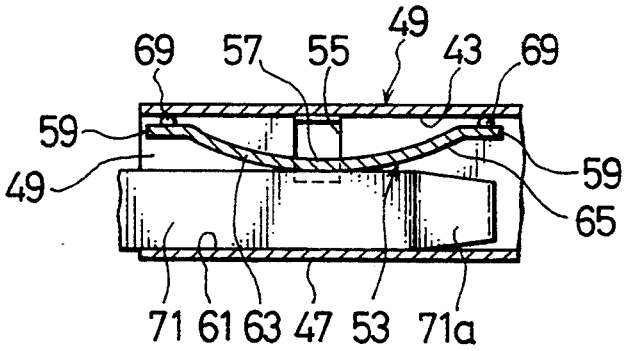

FIGS. 4 to 6 show a female type metal connection terminal 41 corresponding to the second embodiment, respectively.

As shown in the same drawings, the female type metal connection terminal 41 comprises a box type electric contact portion 49 constructed with a base plate 43, side walls 45, 45 respectively formed by bending upward both sides of base plate 43 and an opposing plate 47 opposing the base plate 43; a caulking portion 51 integrally formed with the electric contact portion 49 for caulking and connecting a distal end of wire to the electric contact portion; and an elastic contact piece 53 provided in the electric contact portion 49.

In the middle portions of both side walls 45, 45 of electric contact portion 49 are formed rectangular supporting aperture 55, 55, respectively. The elastic contact piece 53 has an arc-like shape, and ear-like portions 57, 57 extending from the middle portions of both longitudinal sides of the contact piece 53 are supported in the supporting aperture 55, 55, respectively. In more detail, the elastic contact piece 53 is so slightly biased that sliding portions 59 at both end portions of the contact piece 53 are pressed onto and in contact with the base plate 43. In addition, the face of opposing plate 47 facing the base plate 43 acts as contact face 61 which will contact with a corresponding contact face of the mating terminal 71.

As shown in FIG. 6, the elastic contact piece 53 comprises a first part 63, a second part 65 and a central portion 67 between these first and second parts, thereby to construct an arc-like shape in the whole body. The ears 57, 57 mentioned above extend in the transverse direction from both sides of the central portion 67, respectively. Both free ends of these first and second parts 63, 65 are formed into sliding portions 59, 59 which will slide on the base plate 43.

In addition, a pair of convex portions 69, 69 are press-formed in the sliding portions 59, 59 of the elastic contact piece 53 respectively so that these convex portions 69, 69 project onto the base plate 43. These convex portions 69, 69 are formed in similar construction to the convex portions 31, 31 described in the above first embodiment. Namely, the distal end of each convex portion 69 has a spherical shape for contacting with the base plate 43 in the point-contact manner.

Also like the first embodiment, the convex portion 69 can take various shapes such as semispherical or conical shapes.

When the distal end portion 71*a* of mating terminal 71 is inserted between the contact portion 61 and the elastic contact piece 53 of such a female type metal connection terminal 41, as shown in FIG. 6A, the first and second parts 63, 65 of elastic contact piece 53 are slightly transformed so that the convex portions 69, 69, 69, 69 are pressed onto the base plate 43. If the mating terminal 71 is further inserted into the space between the contact portion 61 and the elastic contact piece 53, the first and second parts 63, 65 are further transformed and the convex portions 69, 69, 69, 69 shift slidably on the base plate 43 in the point-contact manner. As a result, the frictional force between the sliding portions 59, 59 and base plate 43 can be reduced as compared with the above-mentioned background art, thereby reducing the insertion force of the mating terminal 71 into the space between the contact portion 61 and the elastic contact piece 53.

Also in this embodiment, since the pair of convex portions 69, 69 are provided in the sliding portions 59, 59, the stability of elastic contact piece 53 to the base plate 43 is highly enhanced.

As stated above, according to the female type metal connection terminal, the free ends of the elastic contact piece can slide on the base plate respectively in the point-contact manner which is achieved by means of the convex portions. Therefore, the frictional force can be so reduced that the insertion of the mating terminal into the electric contact portion can be carried out more easily and smoothly than the background art.

Various modifications will become possible for those skilled in the art after receiving the teachings of the present disclosure without departing from the scope thereof.

What is claimed is:

1. A female type metal connection terminal, comprising:

a base plate;

a contact portion opposing the base plate; and an elastic contact piece provided for contacting said base plate, said elastic contact piece including a sliding end portion for sliding on said base plate, said sliding end portion including protuberant projecting portions deviated from a surface of said sliding end portion towards said base plate.

2. A female type metal connection terminal, comprising:

a base plate;

a contact portion opposing the base plate; and an elastic contact piece provided for contacting said base plate, said elastic contact piece including a sliding portion for sliding on said base plate, said sliding portion being provided with projecting portions extending from said sliding portion towards said base plate, wherein said projecting portions are formed in a semispherical shape.

3. A female type metal connection terminal, comprising:

a base plate;

a contact portion opposing the base plate; and an elastic contact piece provided for contacting said base plate, said elastic contact piece including a sliding portion for sliding on said base plate, said sliding portion being provided with projecting portions extending from said sliding portion towards said base plate, wherein said projecting portions are formed in a conical shape having a distal end which is semispherical.

4. A female type metal connection terminal according to claim 3, wherein said elastic contact piece is formed integrally with said base plate at one end thereof and slidably contacts said base plate at the other end thereof, and having a central portion between said two ends, said control portion projecting toward said contact portion.

5. A female type metal connection terminal according to claim 3, wherein said base plate includes first and second ends and said elastic contact piece slidably contacts said base plate at the ends thereof, and having a central portion between said two ends and projecting toward said contact portion.

6. A female type metal connection terminal according to claim 2, wherein said elastic contact piece is formed integrally with said base plate at one end thereof and slidably contacts said base plate at the other end thereof, said elastic contact piece having a central portion between said two ends, said control portion projecting toward said contact portion.

7. A female type metal connection terminal according to claim 6, further comprising:

side walls provided between first and second sides of said base plate and first and second sides of said contact portion, respectively;

supporting apertures formed in respective portions of said side walls facing said central portion of said elastic contact piece; and ear-like portions extending from said central portion into said supporting apertures.

8. A female type metal connection terminal, comprising:

a base plate;

a contact portion opposing the base plate; and an elastic contact piece provided for contacting said base plate, said elastic contact piece including a sliding end portion for sliding on said base plate, said sliding end portion including means for limiting sliding friction between said sliding end portion and said base plate, comprising at least one point-contact protuberant projecting portion deviated from a surface of said sliding end portion towards said base plate.

9. A female type metal connection terminal according to claim 8, wherein said elastic contact piece is formed integrally with said base plate at one end thereof and slidably contacts said base plate at the other end thereof, and having a central portion between said two ends projecting toward said contact portion.

10. A female type metal connection terminal according to claim 8, wherein said base plate includes first and second ends and said elastic contact piece slidably contacts said base plate at the ends thereof, and having a central portion thereof between said two ends projecting toward said contact portion.

11. A female type metal connection terminal according to claim 8, wherein the at least one projecting portion is formed in a conical shape.

12. A female type metal connection terminal according to claim 8, wherein the at least one projecting portion is formed in a semispherical shape.

13. A female type metal connection terminal according to claim 2, wherein said base plate includes first and second ends and said elastic contact piece slidably contacts said base plate at the ends thereof, said elastic contact piece having a central portion between said two ends, said control portion projecting toward said contact portion.

14. A female type metal connection terminal according to claim 13, wherein said elastic contact piece is bent at said central portion thereof and includes a first part extending from one end thereof to said central portion thereof and a second part extending from said other end thereof to said central portion thereof.

15. A female type metal connection terminal according to claim 13, wherein said elastic contact piece is elongated and curved in an arc-like shape from one end thereof to said central portion thereof and from said other end thereof to said central portion thereof.

16. A female type metal connection terminal according to claim 13, further comprising:

side walls provided between first and second sides of said base plate and first and second sides of said contact portion, respectively;

supporting apertures formed in respective portions of said side walls facing said central portion of said elastic contact piece; and ear-like portions extending from said central portion into said supporting apertures.

17. A female type metal connection terminal according to claim 6, wherein said elastic contact piece is bent at said central portion thereof and includes a first part extending from one end thereof to said central portion thereof and a second part extending from said other end thereof to said central portion thereof.

18. A female type metal connection terminal according to claim 17, further comprising:

side walls provided between first and second sides of said base plate and first and second sides of said contact portion, respectively;

supporting apertures formed in respective portions of said side walls facing said central portion of said elastic contact piece; and ear-like portions extending from said central portion into said supporting apertures.

19. A female type metal connection terminal according to claim 6, wherein said elastic contact piece is elongated and curved in an arc-like shape over the length thereof.

20. A female type metal connection terminal according to claim 19, further comprising:

side walls provided between first and second sides of said base plate and first and second sides of said contact portion, respectively;

supporting apertures formed in respective portions of said side walls facing said central portion of said elastic contact piece; and ear-like portions extending from said central portion into said supporting apertures.

* * * * *